US005850944A

United States Patent [19]

Robbins, III et al.

[11] Patent Number: 5,850,944

[45] Date of Patent: Dec. 22, 1998

[54] MEASURING CAP WITH PIVOTING DISPENSER

[75] Inventors: Edward S. Robbins, III, 2802 E. Avalon Ave., Muscle Shoals, Ala. 35661; Gregory S. Burcham, Spruce Pine, Ala.

[73] Assignee: Edward S. Robbins, III, Muscle Shoals, Ala.

[21] Appl. No.: 557,559

[22] Filed: Nov. 14, 1995

Related U.S. Application Data

[63] Continuation-in-part of Ser. No. 288,896, Aug. 10, 1994, Pat. No. 5,509,582, and a continuation-in-part of Ser. No. 237,336, May 3, 1994, Pat. No. 5,465,871, which is a continuation of Ser. No. 47,086, Apr. 16, 1993, abandoned, which is a continuation of Ser. No. 979,042, Nov. 19, 1992, abandoned.

[51] Int. Cl.[6] ..... B67D 5/38

[52] U.S. Cl. ..... 222/158; 222/449; 222/456; 222/517; 222/556

[58] Field of Search ..... 222/154, 156, 222/157, 158, 424.5, 425, 449, 454, 456, 517, 556

[56] References Cited

U.S. PATENT DOCUMENTS

| | | | |
|---|---|---|---|
| D. 323,781 | 2/1992 | Hamly et al. . | |
| D. 350,877 | 9/1994 | Van Walkenburg et al. . | |
| 1,273,012 | 7/1918 | Souther | 222/456 |
| 1,714,368 | 5/1929 | Hobson | 222/553 X |
| 1,802,284 | 4/1931 | Stoddard | 222/572 X |
| 2,214,437 | 9/1940 | Punte et al. | 206/42 |
| 2,272,798 | 2/1942 | Hacmac | 222/517 |
| 2,339,644 | 1/1944 | Lucas | 222/425 |
| 2,370,820 | 3/1945 | Stott | 222/456 |
| 2,449,285 | 9/1948 | Ekstrom | 222/548 |
| 2,784,884 | 3/1957 | Borie, Jr. | 222/336 |
| 2,804,103 | 8/1957 | Wall | 141/381 |
| 2,811,281 | 10/1957 | Donovan | 222/81 |
| 2,840,124 | 6/1958 | Greene | 141/381 |
| 2,844,266 | 7/1958 | Hofe | 215/64 |
| 2,969,167 | 1/1961 | Libit . | |
| 2,985,343 | 5/1961 | Mask . | |
| 3,020,659 | 2/1962 | Paulini | 40/307 |
| 3,033,420 | 5/1962 | Thomas et al. | 222/456 X |
| 3,140,799 | 7/1964 | Mehr | 222/131 |
| 3,168,223 | 2/1965 | Capers . | |
| 3,209,961 | 10/1965 | Wassell | 222/158 X |
| 3,424,355 | 1/1969 | Blumen | 222/450 |
| 3,486,665 | 12/1969 | La Croce | 222/480 |
| 3,853,250 | 12/1974 | Alpern | 222/517 |
| 3,860,111 | 1/1975 | Thompson | 206/534 |
| 3,948,105 | 4/1976 | Johnson, Jr. | 73/427 |
| 4,069,935 | 1/1978 | Hampel | 215/203 |
| 4,079,859 | 3/1978 | Jennings . | |
| 4,083,467 | 4/1978 | Mullins et al. | 220/904 |
| 4,102,477 | 7/1978 | Yoon | 222/438 |
| 4,144,989 | 3/1979 | Joy | 222/438 |
| 4,164,301 | 8/1979 | Thayer | 220/253 |
| 4,209,100 | 6/1980 | Uhlig | 222/480 X |
| 4,292,846 | 10/1981 | Barnett | 73/427 |

(List continued on next page.)

*Primary Examiner*—Joseph Kaufman
*Attorney, Agent, or Firm*—Nixon & Vanderhye P.C.

[57] ABSTRACT

A measuring dispensing cap for a container comprising a peripheral sidewall and a pivotable flip top supported on the peripheral sidewall for rocking movement about a hinge axis; the hinge axis separating a push panel portion of the flip top from a dispensing panel portion of the flip top; and wherein a measuring chamber is formed an area enclosed the peripheral sidewall underlying the dispensing panel portion; wherein the measuring chamber is defined by a portion of the peripheral sidewall, the dispensing panel portion, and by an angled weir panel extending from the peripheral sidewall downwardly and inwardly, terminating at a weir edge in substantial vertical alignment with the hinge axis, thereby creating a weir opening into the chamber; and wherein the flip top is formed with a depending flange which engages the weir panel edge when the flip top is opened to thereby close the weir opening.

16 Claims, 9 Drawing Sheets

U.S. PATENT DOCUMENTS

| | | | |
|---|---|---|---|
| 4,298,038 | 11/1981 | Jennings . | |
| 4,318,500 | 3/1982 | Melikian . | |
| 4,346,823 | 8/1982 | Eppenbach | 222/456 X |
| 4,376,497 | 3/1983 | Mumford | 222/153 |
| 4,399,928 | 8/1983 | Klingler | 220/335 |
| 4,408,703 | 10/1983 | Libit . | |
| 4,544,063 | 10/1985 | Neward | 206/540 |
| 4,580,687 | 4/1986 | Lewis | 215/237 |
| 4,606,481 | 8/1986 | Conti et al. | 222/562 |
| 4,610,371 | 9/1986 | Karkiewicz | 220/266 |
| 4,613,057 | 9/1986 | Sacchetti et al. | 221/265 |
| 4,635,828 | 1/1987 | Kaufman | 222/185 |
| 4,637,529 | 1/1987 | Knight | 222/452 |
| 4,643,881 | 2/1987 | Alexander et al. | 422/256 |
| 4,646,948 | 3/1987 | Jennings | 222/454 |
| 4,691,821 | 9/1987 | Hofmann | 206/269 |
| 4,693,399 | 9/1987 | Hickman et al. | 222/480 |
| 4,714,181 | 12/1987 | Kozlowski et al. | 222/480 |
| 4,723,693 | 2/1988 | DeCoster | 222/480 X |
| 4,802,597 | 2/1989 | Dubach | 215/307 |
| 4,898,292 | 2/1990 | VerWeyst et al. | 215/237 |
| 4,921,146 | 5/1990 | Salzmann | 222/517 X |
| 4,930,688 | 6/1990 | Arona-Delonghi | 222/484 |
| 4,936,494 | 6/1990 | Weidman | 222/480 |
| 4,955,513 | 9/1990 | Bennett | 222/480 |
| 4,961,521 | 10/1990 | Eckman | 222/142.5 |
| 5,011,048 | 4/1991 | Mark | 222/455 |
| 5,064,106 | 11/1991 | Butler et al. | 222/456 |
| 5,085,331 | 2/1992 | Groya et al. | 215/245 |
| 5,139,181 | 8/1992 | VerWeyst | 222/480 |
| 5,205,424 | 4/1993 | Gaspar | 222/517 X |
| 5,411,186 | 5/1995 | Robbins, III | 222/442 |
| 5,465,871 | 11/1995 | Robbins, III | 222/23 |
| 5,467,903 | 11/1995 | Sorensen et al. | 222/456 X |
| 5,487,494 | 1/1996 | Robbins . | |
| 5,489,049 | 2/1996 | Robbins, III | 222/448 |
| 5,509,582 | 4/1996 | Robbins, III | 222/158 |
| 5,518,152 | 5/1996 | Burcham et al. | 222/452 |

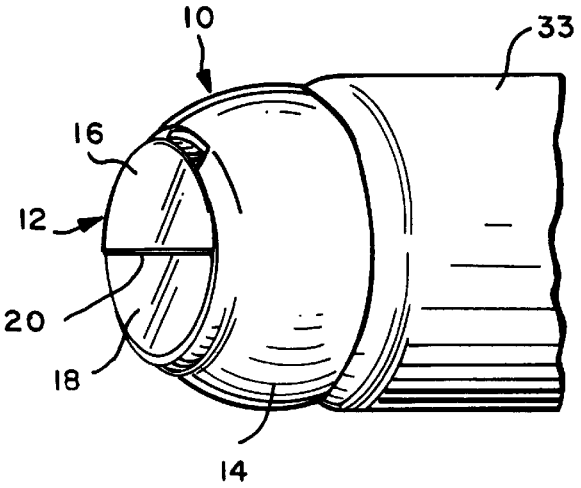
Fig. 1
Fig. 2
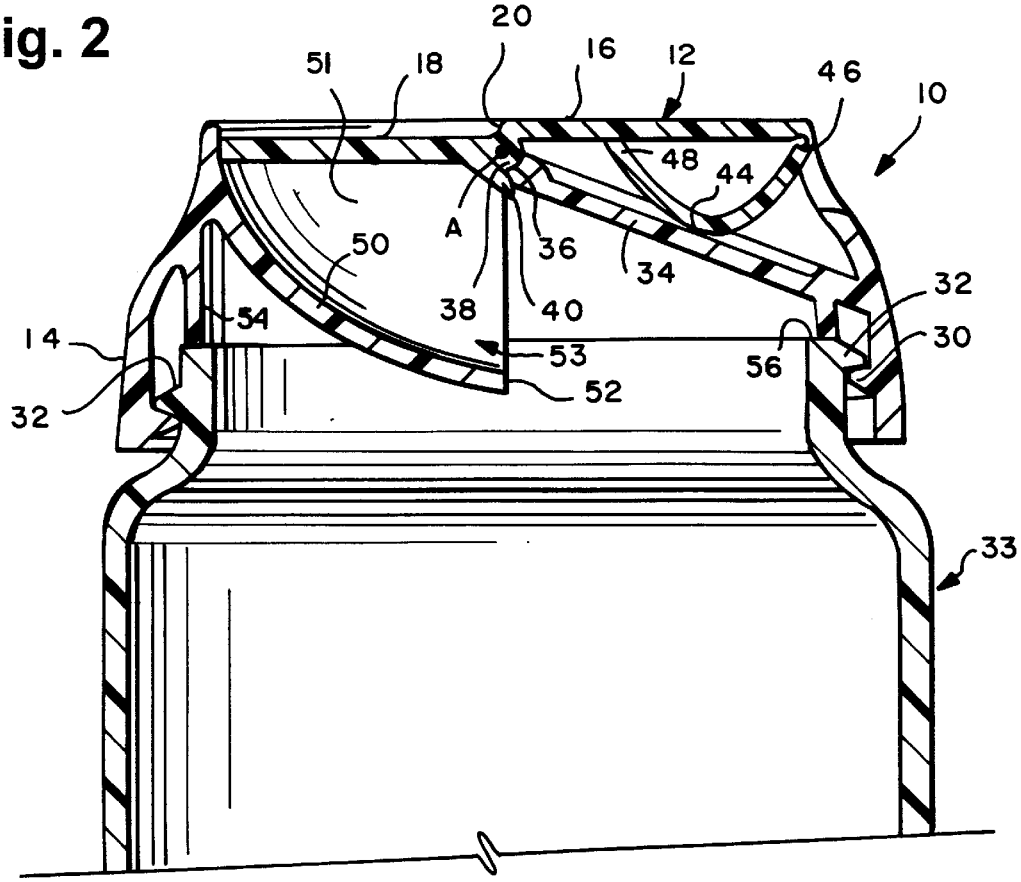

MEASURING CAP WITH PIVOTING DISPENSER

RELATED APPLICATIONS

This application is a continuation-in-part of commonly owned application Ser. No. 08/288,896 filed Aug. 10, 1994 now U.S. Pat. No. 5,509,582 which is a continuation of Ser. No. 08/047,086, filed Apr. 16, 1993, now abandoned, and this application is also a continuation-in-part of commonly owned application Ser. No. 08/237,336 filed May 3, 1994, now U.S. Pat. No. 5,465,871 which is a continuation of Ser. No. 07/979,042 filed Nov. 19, 1992, abandoned.

BACKGROUND AND SUMMARY OF THE INVENTION

The present invention relates generally to dispensing containers and more specifically, to dispensing cap constructions enabling accurately measured amounts of container contents (in granular, particulate, powdered or liquid form) to be dispensed from the cap.

Dispensing containers are, of course, well known and are used in many different industries for many different purposes. One such use is in the food industry, and a specific example includes jars and other similar containers which contain solid foods (such as spices) in particulate, granular or powder-like form. Typically, a measuring spoon or separate measuring cup is utilized in conjunction with the jar or container when accurate amounts are to be obtained.

The present invention eliminates the need for measuring spoons or cups by providing a hollow cap, which serves as its own measuring device, for use with an otherwise conventional container. While the incorporation of a measuring function into a container/cap construction for the discharge of desired amounts of the container contents is not new (see for example, U.S. Pat. Nos. 1,802,284; 2,804,103; 3,860,111; 4,613,057 and 4,635,828), the present invention provides an improved and simplified structure for accomplishing this result.

In a first embodiment, the dispensing cap of this invention includes a pivotable flip top. More specifically, a plastic cap is provided which includes a pivotable top and a depending annular skirt. The skirt incorporates an inverted, partial dome-like (or partial upright bowl-shaped) weir panel which, along with a portion of the pivotable top, form a measuring chamber into which measured amounts of container contents may be poured. This weir panel also serves as a weir dam to prevent excess amounts of container contents from spilling over the edge of the panel and into the measuring chamber. In the exemplary embodiment, the weir panel edge lies parallel to a diametrical center line extending across the top of the cap, (and perpendicular to the longitudinal, vertical axis of the cap) so that an adjacent weir opening into the chamber is semi-circular in shape.

The pivotable flip top includes a panel hingedly secured to the depending skirt along a hinge axis which extends along the same diametrical center line. Thus, one half of the flip top panel overlies the measuring chamber, while the other half of the flip top panel overlies the weir opening, the two half portions (also referred to herein as the dispensing panel portion and the push panel portion) separated by the hinge axis. A semi-circular flip top stop surface underlies the push panel portion, sloping downwardly from the hinge axis to the depending skirt. In this way, the flip top panel can rock back and forth about the hinge axis between closed and open positions. This stop surface terminates at the hinge axis in a seat or cradle in which a hinge axis rib on the underside of the flip top is received. In the exemplary embodiment, a living leaf-type spring is hinged to the push panel portion of the flip top and is interposed between the push panel portion and the sloped flip top stop surface. In this way, the flip top panel is resiliently mounted such that when the push panel portion is depressed, a force is exerted against the leaf-type spring, and when the push panel portion is released, the leaf spring will cause it to pivot in the opposite direction, to a closed position.

In the lower portion of the annular skirt, an internal thread (or other suitable means) is provided for enabling conventional securement of the cap to the threaded upper end of a container or jar.

In this first embodiment, diametrically opposed pins or projections, aligned with the hinge axis, extend from the flip top panel and snap into mating dimples provided at the upper end of the depending skirt so as to hold the flip top panel in place. At the same time, the semi-circular peripheral portion of the measuring chamber, at the uppermost portion of the depending skirt, may be provided with a snap-type engagement surfaces for interaction with the peripheral edge of the dispensing panel portion of the flip top panel, to thereby enable sealing engagement when the flip top panel is rocked to a closed position.

In a variation of the first embodiment of the invention, the integral leaf spring may be omitted such that the flip top panel must be moved manually from the open to the closed position.

In the above described embodiments, an internal annular ring, spaced radially inwardly of (and concentric with) the depending skirt, seats on the upper annular rim of the container or jar to prevent any egress of container contents and also to serve as a stop limit to the screw threaded action between the threads on the cap and the threads on the container.

In a second embodiment of the invention, a substantially rectangularly shaped flip top is mounted for pivoting movement within a similarly shaped opening formed in the top surface of the cap. In this embodiment, the hinge axis of the flip top as well as the weir edge of the internal weir panel are vertically aligned with each other, but laterally offset from a parallel, diametrical center line through the cap. This arrangement is particularly advantageous in that the weir panel is more effective in preventing additional container contents from spilling over the weir edge into the measuring chamber as the measured amount of contents is disposed from the chamber via the flip top.

In a third and presently preferred embodiment, the above described rectangular flip top incorporates a measuring chamber seal panel which seals the weir aperture against further transfer of material to the measuring chamber when the flip top is opened and the measured amount dispensed from the chamber.

In all of the exemplary embodiments, at least the flip top panel of the measuring cap is made of clear transparent plastic. The remaining portions of the cap may be opaque or transparent as desired.

Accordingly, in its broadest aspects, the present invention relates to a measuring dispensing cap for a container comprising a peripheral sidewall and a pivotable flip top, the flip top mounted for pivotal motion about a horizontal hinge axis located between opposite ends of the flip top, the peripheral sidewall having an internal weir panel having an edge extending parallel to and vertically aligned with the hinge axis, and defining, in cooperation with at least a portion of the top, an open-ended measuring chamber within the cap.

In another aspect, the invention relates to a measuring dispensing cap for a container comprising a peripheral sidewall and a pivotable flip top supported on the peripheral sidewall for rocking movement about a hinge axis corresponding to a diametrical center line through the cap; the hinge axis separating a push panel portion of the flip top from a dispensing panel portion of the flip top; and wherein a measuring chamber is formed within the peripheral sidewall underlying the dispensing panel portion.

Other objects and advantages will become apparent from the detailed description which follows.

BRIEF DESCRIPTION OF THE DRAWINGS

FIG. 1 is a partial perspective of the measuring cap and associated container of this invention, incorporating a pivotable flip top, shown in the closed position;

FIG. 2 is a partial side section of the measuring cap and associated container of this invention, shown in an upright position, with the pivotable flip top in a closed position;

DETAILED DESCRIPTION OF THE DRAWINGS

Figure 3:
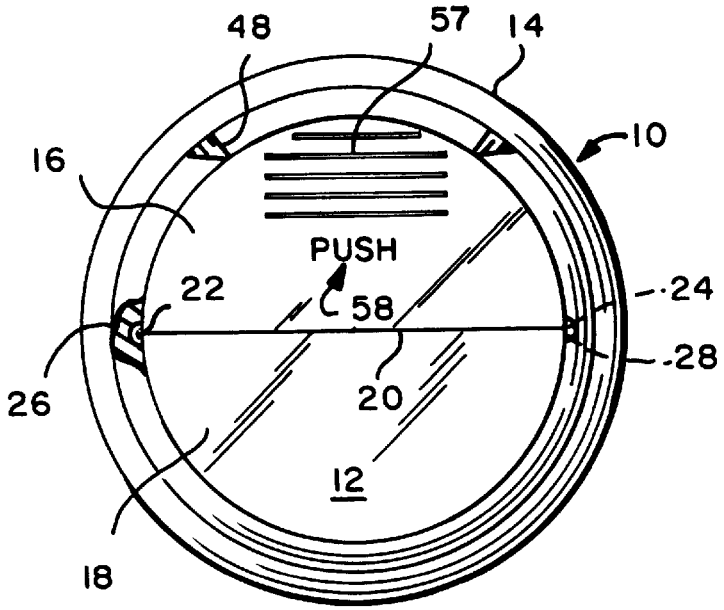
FIG. 3 is a top plan view of the measuring cap of this invention.

With reference to FIGS. 1 and 2, a measuring cap 10 of this invention includes a pivotable flip top 12 and a peripheral skirt or sidewall 14. The flip top 12 is in the form of a substantially circular disk or panel, wherein one half (i.e., semi-circular in the exemplary embodiment) portion 16 (the push panel portion) of the disk is raised slightly above the plane of a second half portion 18 (the dispensing panel portion), along a diametrical center line 20. This juncture of the half portions 16 and 18 also corresponds to the pivot or hinge axis of the flip top panel 12 as described in greater detail below.

Figure 4:
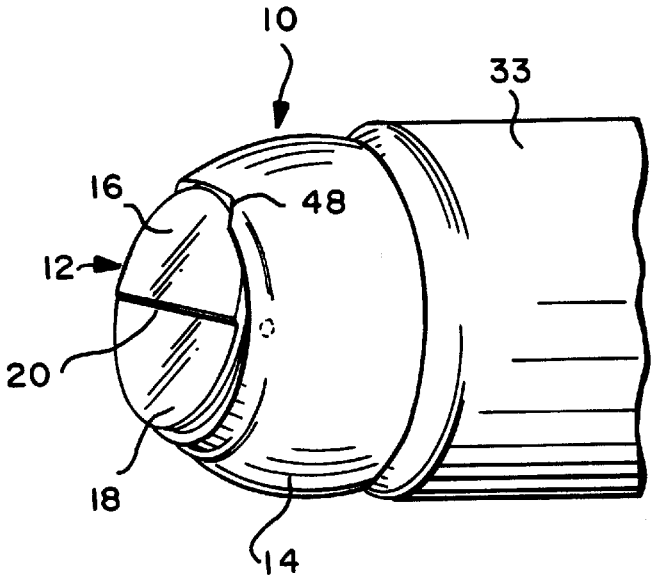
FIG. 4 is a partial perspective of the measuring cap and associated container of this invention, incorporating a pivotable flip top, shown in the open position.
Figure 5:
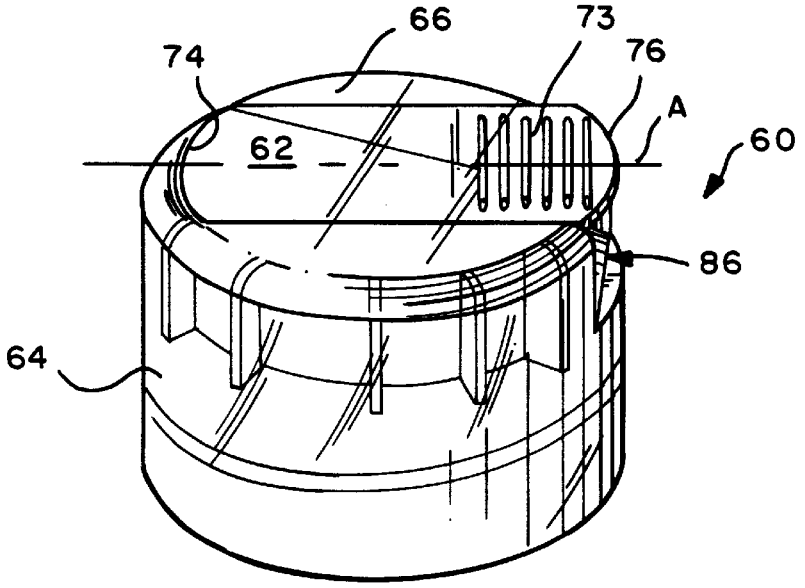
FIG. 5 is a perspective view of a measuring cap incorporating a pivotable flip top in accordance with a second embodiment of the invention.

As best seen in FIG. 3, the flip top panel 12 is provided with oppositely extending beads or projections 22, 24 which snap into complementary recesses or dimples 26, 28 (all of which are aligned along the hinge axis) formed in the upper end of the sidewall or skirt 14. This arrangement holds the flip top panel in place atop the sidewall 14, and allows the user to press down on the push panel portion 16 and to thus pivot the flip top panel 12 in a clockwise direction (as viewed in FIG. 2) about the pivot axis or center line 20 to an open position shown in FIG. 4.

Referring again to FIG. 2, the sidewall or depending skirt 14 is formed with interior surfaces which facilitate attachment of the cap to a container, and which enable precisely measured amounts of container contents to be dispensed from the cap. More specifically, the sidewall 14 is formed with an internal screw thread 30 adapted to cooperate with a cooperating thread 32 on the container 33. It will be appreciated that other attachment mechanisms (e.g., snap fit) are applicable as well.

The sidewall portion underlying the push panel 16 is formed with an internal flip top stop surface or wall 34 which tapers upwardly from just below the mid-point of the sidewall 14 to a location adjacent the center line or hinge axis 20. This stop surface 34 is thus substantially semicircular in shape (when viewed in plan). Along the center line 20, the uppermost edge of surface or wall 34 is formed with a curved rib or seat 36 which receives a similarly curved rib 38 formed on the underside of the flip top 12, along the center line 20. At the same time, a downwardly extending hook-like projection 40 partially wraps under the wall 34 as best shown in FIG. 2. This arrangement in conjunction with the above described beads 22, 24 and dimples 26, 28 provides a strong, reliable and easy-to use flip top.

An integral leaf spring 44 is hinged to the push panel 16 of the flip top 12 by means of a living hinge 46. The leaf spring 44 is of substantially U or rounded V-shape, where the base of the U or rounded V resiliently engages the stop surface 34, and the remote leg 48 engages the underside of the push panel 16, as best seen in FIG. 2. It will be appreciated that when the push panel 16 is pressed downwardly, the leaf spring 44 flattens and then, upon release of the downward force on push panel 16, returns the latter to the closed position shown in FIG. 1. In the absence of spring 44, or any other suitable return mechanism, the user can simply press downward on the push panel portion 16 of the flip top to thereby pivot the flip top 12 in a counterclockwise direction (as viewed in FIG. 2) to the closed position. In any event, to facilitate pushing the panel portion 16, part of the sidewall 14 may be cut out as shown at 48.

An internal weir dam or panel 50 is formed interiorly of the sidewall 14, underlying the dispensing panel portion 18 of the flip top 12. Surface 50 is shaped substantially as an inverted, one-half dome shape, extending downwardly from the upper end of the sidewall 14. The surface 50 terminates at weir edge 52 parallel to center line 20 and in vertical alignment with both the center line 20 (and hinge axis of the flip top), thus creating a weir opening 53 by which container contents may be transferred to the measuring chamber 51.

There is also an annular seal between the cap 10 and the container 33 in the form of an interior ring 54, radially inwardly spaced from skirt 14. This annular, interior ring extends about the full 360° of the cap, and is designed to engage the upper rim edge 56 of the container 33. This arrangement prevents any egress of container contents and undesirable clogging of such contents in the area of screw threads 30, 32.

It will be appreciated that the flip top panel 12 should be formed of transparent material (e.g., a transparent plastic) so that the user can determine when the chamber is full. The remaining portions of the cap, including the skirt 14 and weir panel 50, may be transparent or opaque as desired.

In addition, as shown in FIG. 3, the push panel portion 16 of the flip top panel 12 may be provided with friction strips 57, and with integral indicia, such as the "PUSH" instruction shown in FIG. 3 at 58. Moreover, the measuring chamber can be designed for single amount transfers (e.g., 1 tablespoon), but in the event multiple amount transfers are desired, the dispensing panel 18 which overlies the measuring chamber, can be provided with indicia as well, indicating various levels corresponding to certain amounts.

The measuring cap is used as follows. The user tilts the container 33 to one side, such that container contents can be spilled over the edge 52, through the opening 53 and into the measuring chamber 51 defined by the surface 50 and dispensing panel portion 18. Once the desired amount is transferred to the chamber 51, the container 33 is tilted back slightly to prevent any additional contents from spilling over the edge 52 (but still approaching a horizontal orientation). The flip top panel 12 is then pivoted to the open position shown in FIG. 4 by pushing downwardly on push panel portion 16, and the measured contents slide out of the chamber 51 by reason of the dome-like surface 52. Release of the push panel portion 16 allows spring 44 to return the flip top to the closed position.

Turning now to FIGS. 5–16, another measuring cap construction is illustrated at 60 and includes a pivotable flip top 62 and a peripheral sidewall 64 joined to a remaining top portion 66. The flip top 62 is in the form of a substantially rectangular panel, centrally located within the top portion 66 along a first diametrical center line A, and pivotable about a hinge line 68 offset from a second diametrical center line B perpendicular to the first diametrical center line A. This relationship between diametrical center lines A and B and the hinge line 68 is best understood by reference to FIG. 7. The hinge line 68 essentially defines within the flip top 62 a dispensing panel portion 70 and a push panel portion 72 which maybe provided with ribs 73 to facilitate manipulation of the flip top as described further herein. The flip top 62 is arranged such that an edge 74 of the dispensing panel portion 70 lies within the overall cap diameter while an opposite edge 76 of the push panel portion 72 lies substantially on the cap maximum diameter.

Figure 6:
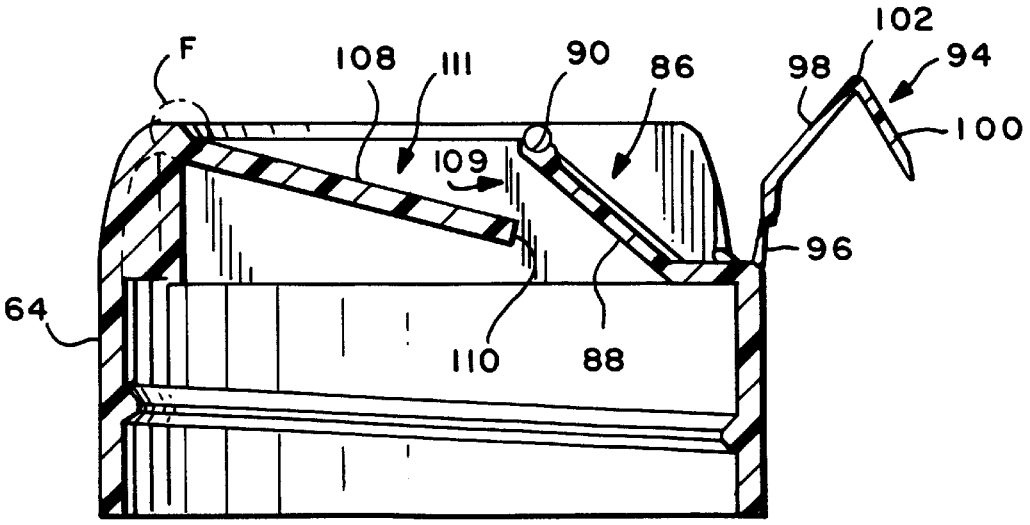
FIG. 6 is a side elevation of the cap illustrated in FIG. 5, but with the flip top removed and an integral spring shown in an inoperative position as manufactured.
Figure 7:
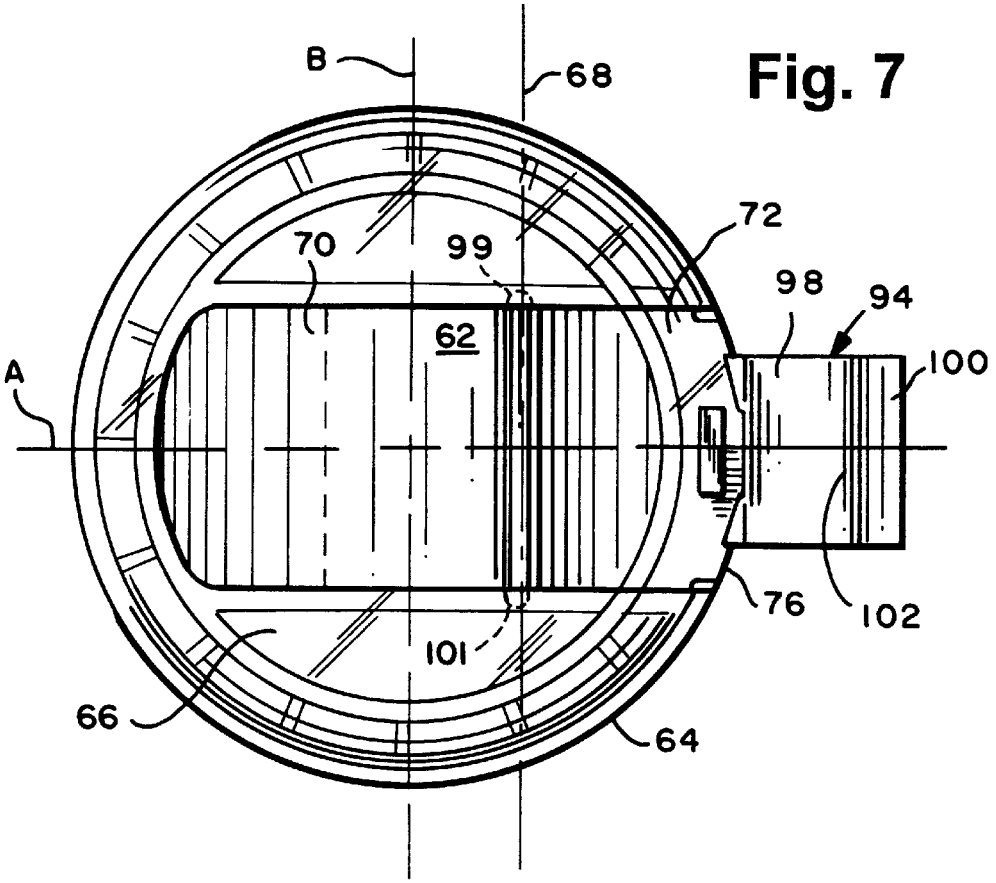
FIG. 7 is a top plan view of the cap shown in FIG. 6.
Figure 8:
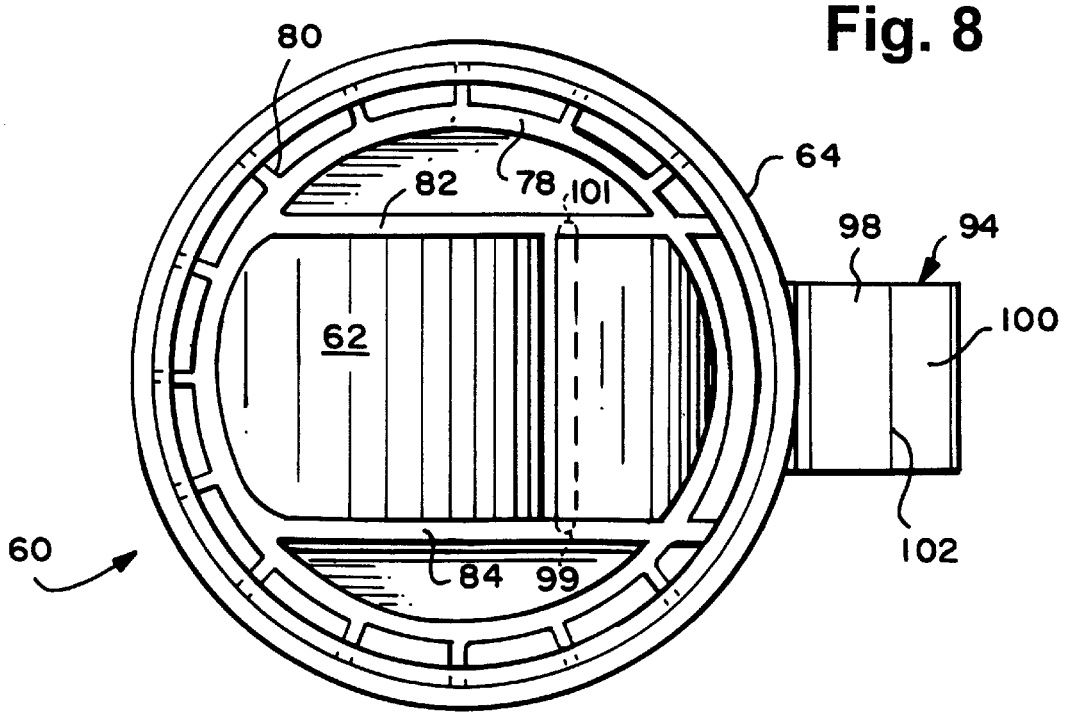
FIG. 8 is a bottom plan view of the cap shown in FIG. 6.
Figure 9:
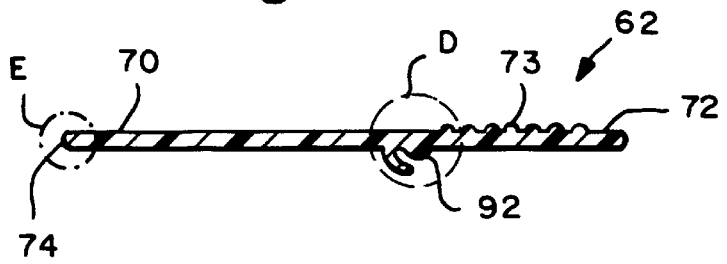
FIG. 9 is a side elevation of a flip top incorporated in the cap shown in FIG. 5.
Figure 12:
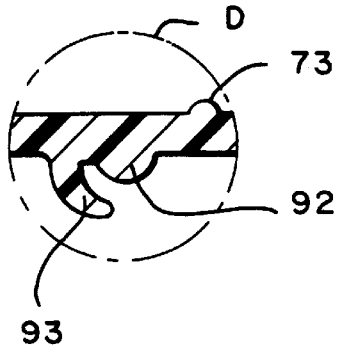
FIG. 12 is an enlarged detail D taken from FIG. 9.
Figure 10:
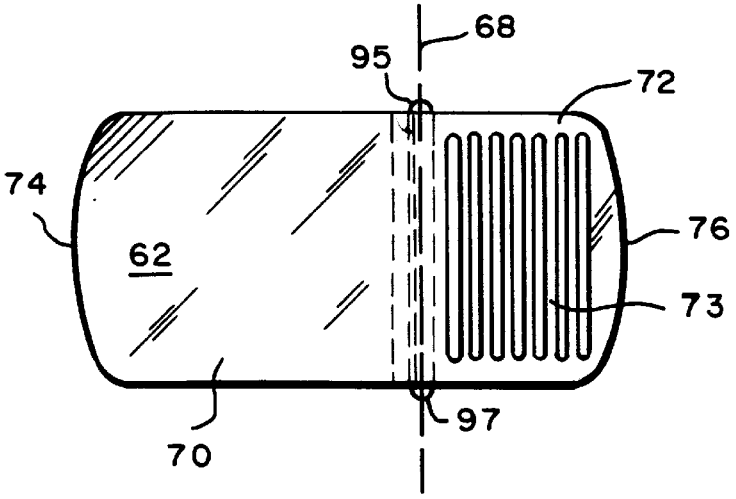
FIG. 10 is a top plan view of the flip top shown in FIG. 9.

Referring specifically to FIGS. 6, 7 and 8, the cap, absent the flip top 62, is of one piece molded plastic construction, and preferably transparent. In addition to the peripheral sidewall 64 and contiguous top portion 66, the cap 60 is formed in its upper half with a radially inner skirt 78 connected to the radially outer sidewall or skirt 64 by a plurality of radial webs or spokes 80. In addition, a pair of parallel webs 82, 84, spaced apart a distance substantially equal to the width of the flip top 62, extend across the radially inner skirt 78, parallel to the center line A. Stated otherwise, the webs 82, 84 comprise parallel chords within the diameter of the inner skirt 78, but also extend radially beyond the skirt 78 to the outer skirt 64, as best seen in FIG. 8. The outer skirt 64 is cut out in an area underlying the flip top 62 to form a recess 86 (FIGS. 5 and 6) defined in part by portions of the webs 82, 84 extending to the outer skirt 64. This recess provides the space needed for the pivoting movement of the flip top 62 between open and closed positions.

Figure 15:
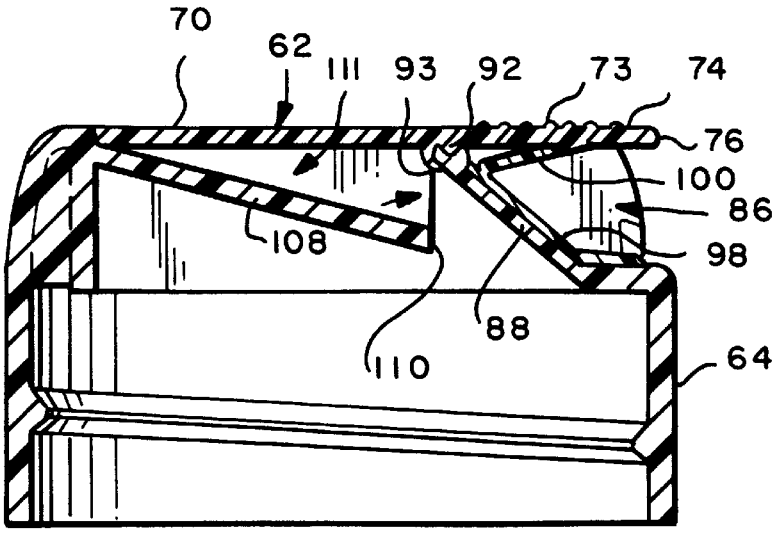
FIG. 15 is a side section of the cap illustrated in FIG. 5, with the pivotable flip top shown in a closed position.
Figure 16:
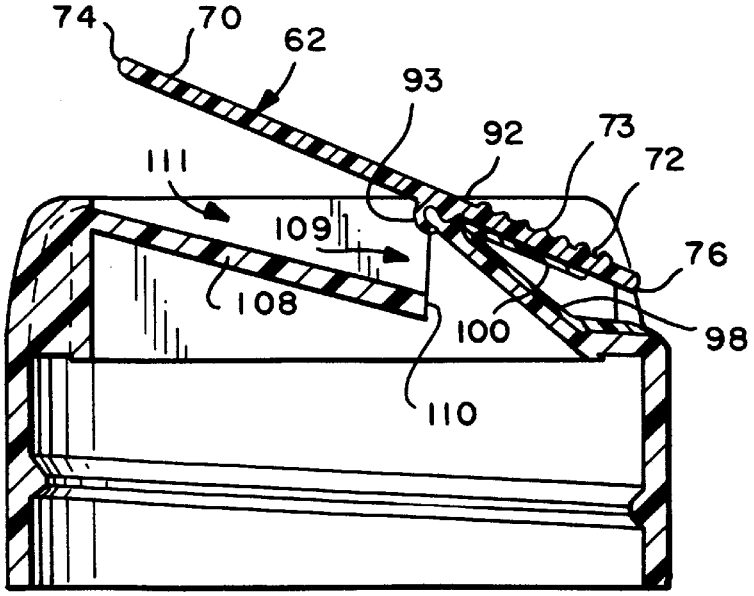
FIG. 16 is a side section similar to FIG. 15, but with the flip top shown in an open position.
Figure 17:
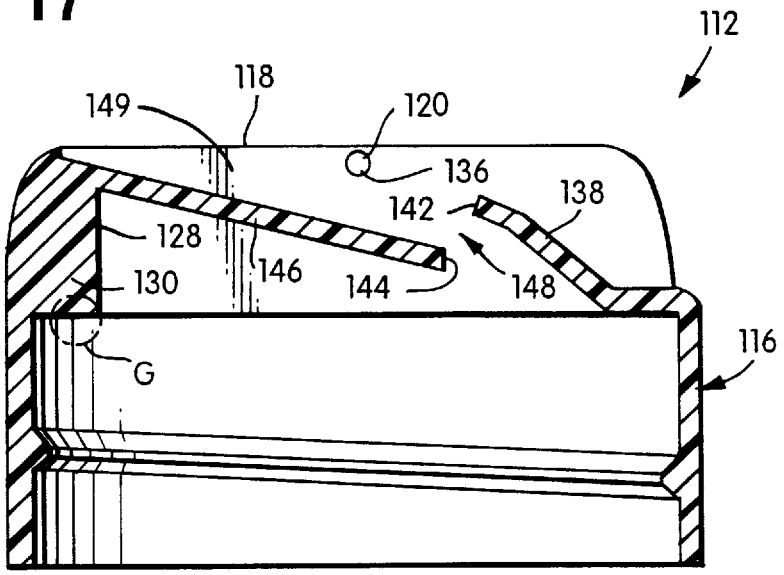
FIG. 17 illustrates a side section of a measuring cap in accordance with a third and preferred embodiment of the invention, but with the flip top element removed.
Figure 18:
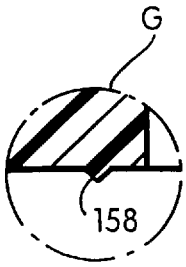
FIG. 18 is an enlarged detail G taken from FIG. 17.

An inclined wall 88 (FIG. 6) is formed between the webs 82, 84, extending angularly upwardly from the sidewall 64 to a pivot cradle or groove 90 extending between the webs 82, 84, parallel to, but laterally offset from, the center line B. This arrangement permits an integral pivot pin or rib 92 (FIGS. 9, 11, 15 and 16) on the lower surface of flip top 62 to lie within the cradle or groove 90, thus allowing the flip top 62 to rock back and forth about the pin 92 (coincident with hinge line 68) as described further herein. Note also the hook-like projection 93 which engages the exterior surface of the cradle 90, as best seen in FIGS. 15 and 16. This arrangement insures secure attachment of the flip top 62 to the cap. In addition, pivot rib or pin 92 extends beyond opposite sides of the flip top to form dimples or projections 95, 97 which are received in complementary recesses or detents 99, 101 as shown in FIGS. 7 and 8. Here again, these elements facilitate both good pivoting action and retention of the flip top 62 relative to the cap.

During the molding of the cap 60, an integral leaf hinge 94 is formed along the edge of the cut out recess 86 and connected to the cap sidewall by a connecting web 96 (FIG. 6). The leaf spring 94 includes a base portion 98, which is adapted to conform to the cap top and inclined wall 88 as best seen in FIG. 16, and a spring portion 100 which, in use, is partially folded back at 102 (within the recess 86) to extend radially outwardly and upwardly as seen in FIG. 15. It will be appreciated that, when folded over into place (FIG. 15), the spring portion 100 will engage the underside of flip top 62 within the recess 86, biasing the flip top 62 in a counterclockwise direction (as viewed in FIG. 15) to a closed position. By pressing downwardly on the push panel portion 70, the spring force can be overcome so that the flip top pivots to an open position shown in FIG. 16. Upon release of the push panel portion 70, the spring 100 will automatically close the flip top.

Figure 13:
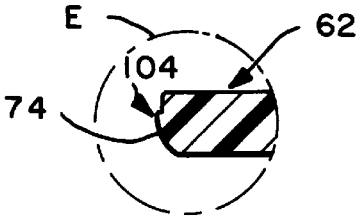
FIG. 13 is an enlarged detail E taken from FIG. 9.
Figure 11:
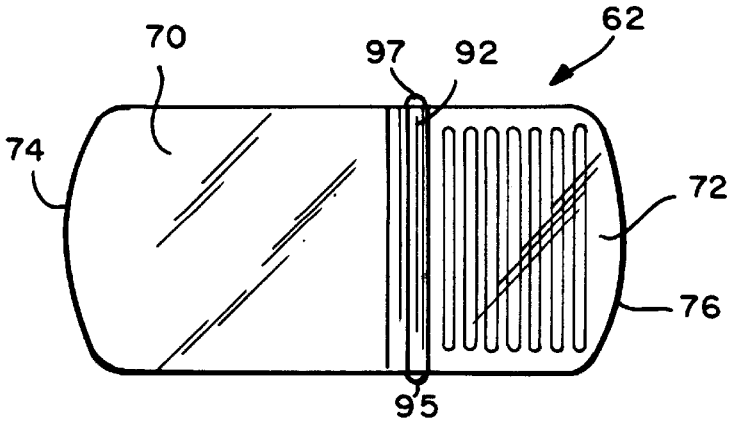
FIG. 11 is a bottom plan view of the flip top shown in FIG. 9.
Figure 14:
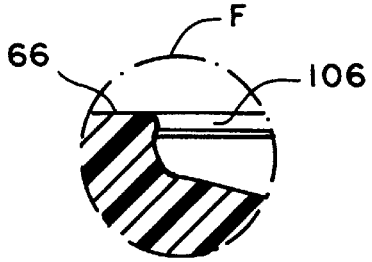
FIG. 14 is an enlarged detail F taken from FIG. 6.

With reference to FIGS. 13 and 14, it may be seen that flip top edge 74 is formed with a radially short shoulder or edge 104 which is designed to cooperate with a radially projecting lip 106 formed in the opening in the cap top surface 66 which receives the flip top 62. When moved to the closed position, the shoulder 104 will snap into place as it passes over the lip 106, to thereby effect a substantially air tight seal. It will be appreciated that other arrangements may be employed between cooperating surfaces of the flip top 62 and cap top 66, depending on requirements. For some applications, an airtight seal may not be necessary.

A second inclined wall 108 extends radially inwardly and downwardly, again between the webs 82, 84, from the sidewall 64 at a location substantially diametrically opposed to the sidewall location where the latter joins to the wall 88. The wall 108 thus forms a weir panel, including a weir edge 110 which extends parallel to the hinge line 68 and substantially aligned therewith in a vertical plane. A vertical gap between the pivot cradle 90 (and hence hinge line 68) establishes a weir opening 109 by which a certain predetermined amount of container contents may be transferred from the container to the cap, and specifically to the measuring chamber 111 defined by weir panel 108, webs 82, 84, and dispensing panel portion 70 of the flip top 62. By locating the weir edge 110 directly under the hinge line 68, and laterally offset from the center line B, the weir panel 108 is more effective to prevent additional container contents from spilling over the edge 110 when the measured amount of contents dispensed from the measuring chamber 111 via the flip top 62.

Otherwise, the manner of operation of this presently preferred embodiment is substantially as described earlier in connection with the embodiment illustrated in FIGS. 1–5.

Turning now to FIGS. 17–22, another measuring cap is illustrated in accordance with a third and preferred embodiment of the invention. The cap is generally similar to that which is illustrated in FIGS. 5–16 but with a few significant exceptions as noted below.

The cap 112 includes a pivotable flip top 114 (FIGS. 19 and 20) and a peripheral sidewall 116 joined to a remaining top portion 118. The flip top 114 is in the form of a substantially rectangular panel, centrally located within the top portion 118 along a first diametrical center line A' (FIG. 20), and pivotable about a hinge line 120 which lies along a second diametrical center line B' (FIG. 20) perpendicular to the first center line A'. The hinge line 120 essentially defines within the flip top 114 a dispensing panel portion 122 and a push panel portion 124 which may be provided with ribs (similar to ribs 73) to facilitate manipulation of the flip top. This flip top 114 is generally similar to the earlier described flip top 62, with the exception that the hinge line is coincident with, as opposed to offset from, the diametrical center line B'. In addition, the outer edge of the flip top is more clearly horizontal, nesting in a similarly shaped surface of the top portion 118, although it should be understood that the same type of projection/detent arrangement as in the previously described embodiment (at 104, 106) may be employed.

The cap 112, like the cap 60, is of one piece molded plastic construction, preferably transparent.

In addition to the peripheral sidewall 116 and contiguous top portion 118, the cap 112 is formed in its upper half with a radially inner skirt 128 connected to the radially outer sidewall or skirt 116 by a plurality of radial webs or spokes 130.

In addition, a pair of vertically arranged, parallel webs (similar to webs 82, 84), but not shown here, are spaced apart a distance substantially equal to the width of the flip top 114 in the same manner as the previously described embodiment.

In this presently preferred embodiment, the flip top is pivotally supported within the cap by means of a pair of lateral projections 132, 134 which are seated within complementary recesses (one shown at 136) formed in the top portion 118. The flip top is not additionally supported, however, by any laterally extending cradle or groove as in the previously described embodiment. This is evident from FIGS. 17, 21 and 22 in that the inclined wall 138 extends angularly upwardly from the sidewall 116 but terminates well short of the hinge line 120. More specifically, the inclined wall 140 terminates at an edge 142 located above and slightly laterally spaced from a weir edge 144 of the weir panel 146. The space between forms the weir opening 148 by which contents of the container are transferred into the measuring chamber 149.

Figure 19:
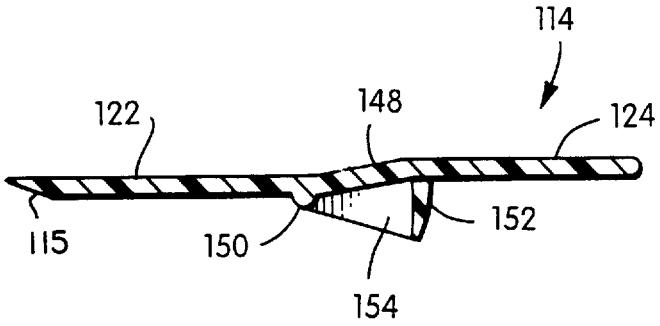
FIG. 19 is a section taken along the line 19—19 of FIG. 20.
Figure 20:
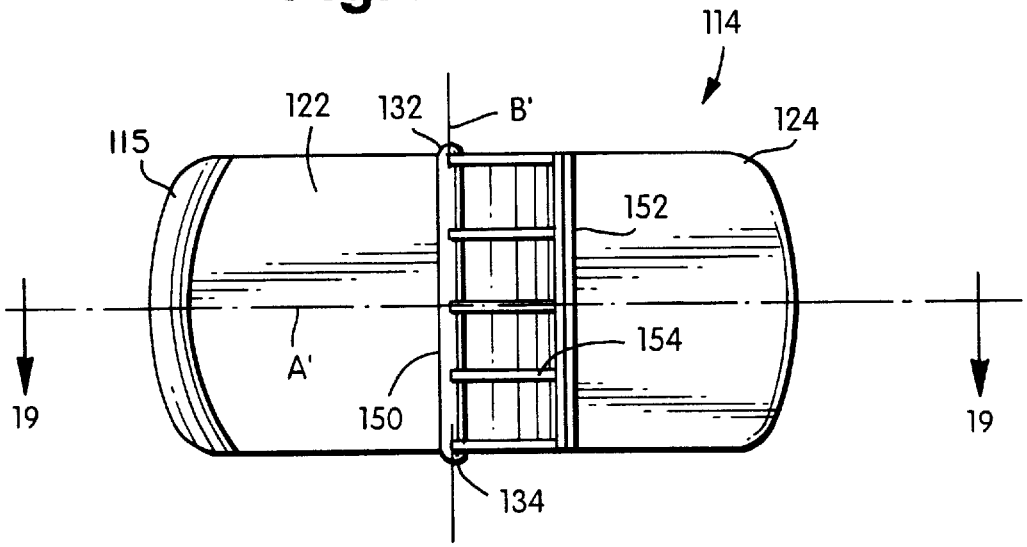
FIG. 20 is a bottom plan view of a flip top shown in FIG. 19, for use with the measuring cap shown in FIG. 17.

With reference now to FIG. 19, the sectional view of the flip top 114, illustrates the manner in which the push panel portion 124 is raised slightly out of the plane of the dispensing panel portion 122 via an inclined transition portion 148. Note also the transverse rib which lies along the hinge line 120 at the one end of the transition portion 148, and which terminates at the projections 132, 134. At the other end of the transition portion 148, there is a downwardly extending chamber closing flange 152, and with further reference to FIG. 20, it may be seen that the rib 150 along the hinge line 120 is connected to the chamber closing flange 152 by means of a series of reinforcing ribs 154.

Figure 21:
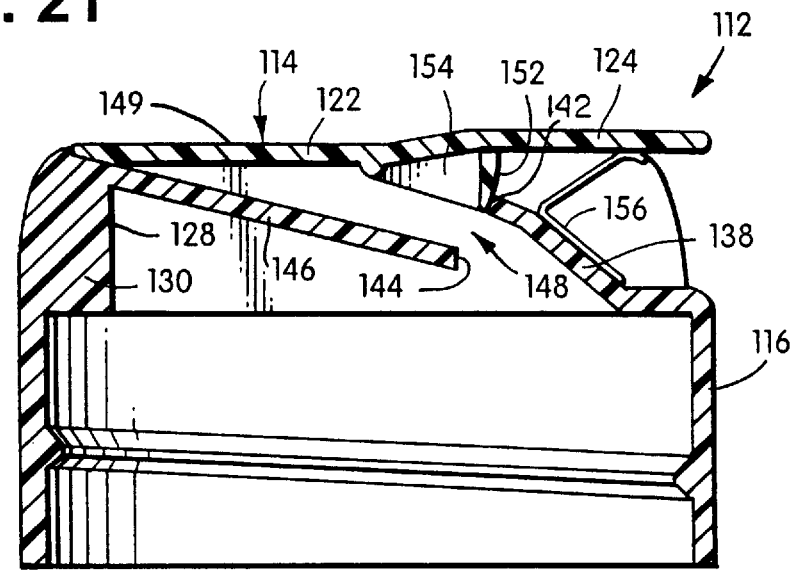
FIG. 21 is a side elevation of the measuring cap shown in FIG. 17, but with the flip top element and associated spring installed and in a closed position.
Figure 22:
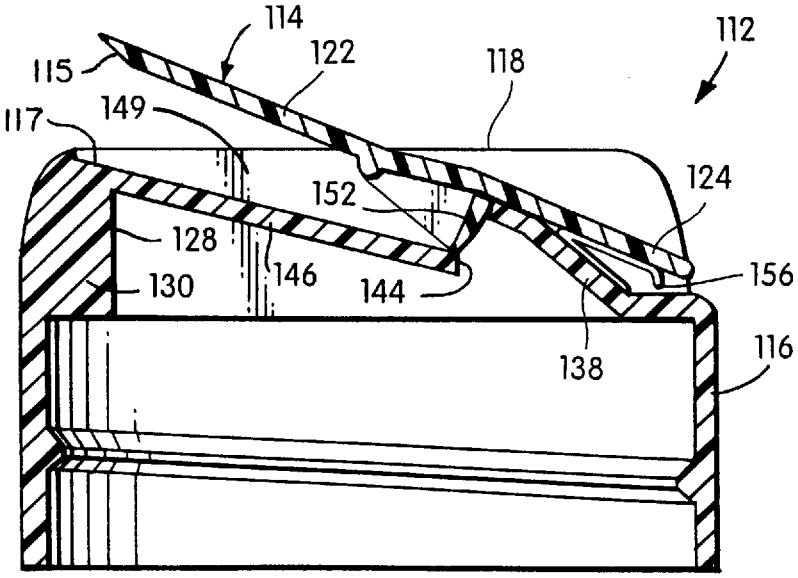
FIG. 22 is a side section similar to FIG. 21, but with the flip top shown in an open position.

Turning to FIG. 21, when the flip top 114 is assembled to the dispensing cap 112 by snapping the projections 132, 134 into the corresponding recesses or detents (one shown at 136), the chamber closing flange 152 is located so as to slide along the edge 142 of the inclined wall 138. FIG. 21 also illustrates a bent leaf spring 156 interposed between the exterior of the inclined wall 138 and the underside of the flip top 114. The spring 156 thus biases the flip top 114 to a closed position (about the hinge line 120) in the same manner as the previously described embodiment. With reference now to FIG. 22, it may be seen that when the flip top 114 is pushed downwardly to an open position, the chamber closing flange 152 slides across the edge 142 and engages the edge 144 of the weir panel 146. In this way, the weir opening 148 is closed or sealed against any further transfer of contents from the container into the dispensing chamber 149 when the container and cap are tilted to facilitate dispensing of the contents from the measuring chamber. This arrangement provides further insurance that only the desired measured amount will be dispensed from the cap. When the push panel portion 124 of the flip top 114 is released, the spring 156 will automatically move the flip top 114 to the closed position shown in FIG. 21, with the weir opening 148 now re-opened.

Referring again to FIGS. 17 and 18, an arcuate rib 158 is formed on the lower edge of inner wall 128, the rib designed to set on the upper edge of the container or jar rim to create a seal between the cap 112 and associated container (not shown).

Of course, the measuring chamber dimensions can be altered depending on the particular cap application. In one exemplary embodiment, the container and measuring cap may be used to dispense single dose amounts of, for example, an artificial sweetener or the like, in which case the measuring chamber may be sized to hold 1 oz. of sweetener.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A measuring dispensing cap for a container comprising a peripheral sidewall and a pivotable flip top, said flip top having a push panel portion and a dispensing panel portion separated by a hinge axis, said flip top mounted for pivotal motion about said hinge axis, said peripheral sidewall having an internal weir panel having an edge extending parallel to and substantially vertically aligned with said hinge axis thus establishing a weir opening between said weir edge and said flip top, and defining, in cooperation with at least a portion of said flip top, an open-ended measuring chamber within said cap; and wherein an internal surface is located within said peripheral sidewall and below said push panel portion, and further wherein a spring is interposed between said internal surface and said push panel.

2. The measuring dispensing cap of claim 1 wherein the measuring chamber is defined by said internal weir panel, said dispensing panel portion and a portion of said peripheral sidewall.

3. The measuring dispensing cap of claim 2 wherein at least said flip top is constructed of substantially transparent plastic.

4. The measuring dispensing cap of claim 1 wherein said spring is formed integrally with said push panel portion.

5. The measuring dispensing cap of claim 1 wherein said internal weir surface is shaped substantially as an inverted dome, extending substantially 180° about the peripheral sidewall.

6. The measuring dispensing cap of claim 1 wherein said weir panel edge and said hinge axis are laterally offset from a diametrical center line of said cap.

7. The measuring dispensing cap of claim 1 wherein said flip top is substantially rectangular in shape, and is received in a complementary opening formed in a top surface of said cap.

8. The measuring dispensing cap of claim 7 wherein cooperating surface means are provided for establishing a substantially airtight seal between a portion of said flip top and the top surface of said cap.

9. The measuring/dispensing cap of claim 1 wherein said flip top is formed with a depending flange which engages the weir panel edge when the flip top is opened to thereby close the weir opening.

10. A measuring dispensing cap for a container comprising a peripheral sidewall and a pivotable flip top, said flip top having a push panel portion and a dispensing panel portion separated by a hinge axis, said flip top mounted for pivotal motion about said hinge axis, said peripheral sidewall having an internal weir panel having an edge extending parallel to and vertically aligned with said hinge axis thus establishing a weir opening between said weir edge and said flip top, and defining, in cooperation with at least a portion of said flip top, an open-ended measuring chamber within said cap; wherein a stop surface is located below said push panel portion, and further wherein a spring is interposed between said stop surface and said push panel; wherein said flip top is substantially rectangular in shape, and is received in a complementary opening formed in a top surface of said cap; and wherein an angled wall extends radially inwardly and upwardly from said peripheral sidewall, terminating in a cradle for receiving a rib formed on an underside of said flip top.

11. The measuring dispensing cap of claim 10 wherein said cradle and said rib define said hinge axis.

12. A measuring dispensing cap for a container comprising a peripheral sidewall and a pivotable flip top supported on said peripheral sidewall for rocking movement about a hinge axis; said hinge axis separating a push panel portion of said flip top from a dispensing panel portion of said flip top; and wherein a measuring chamber is formed an area enclosed said peripheral sidewall underlying said dispensing panel portion; wherein said measuring chamber is defined by a portion of said peripheral sidewall, said dispensing panel portion, and by an angled weir panel extending from said peripheral sidewall downwardly and inwardly, terminating at a weir edge in substantial vertical alignment with said hinge axis, thereby creating a weir opening into said chamber; and wherein said flip top is formed with a depending flange which engages the weir panel edge when the flip top is opened to thereby close the weir opening.

13. A measuring dispensing cap for a container comprising a peripheral sidewall and a pivotable flip top mounted for pivotal motion about a hinge axis which separates said flip top into a push panel portion and a dispensing panel portion; said cap provided with an internal weir panel having a first free edge extending parallel to said hinge axis, said weir panel, said push panel portion and part of said peripheral sidewall defining a measuring chamber; an internal surface extending from said peripheral sidewall toward said weir panel and having a second free edge spaced from said first free edge and defining a weir opening therebetween; and a shut-off blade extending downwardly from said flip top between said push panel portion and said dispensing panel portion, said shut-off blade engaged with said second free edge when said flip top is in a closed position and with said first free edge when said flip top is in an open position.

14. The measuring cap of claim 13 wherein said flip top and said measuring chamber are substantially rectangular in shape.

15. The measuring cap of claim 13 wherein a spring is located between said surface portion and said push panel portion.

16. The measuring cap of claim 15 wherein said spring is formed integrally with said flex top.

* * * * *